US006705229B2

(12) United States Patent
Frankenberger

(10) Patent No.: US 6,705,229 B2
(45) Date of Patent: Mar. 16, 2004

(54) METHOD AND DEVICE FOR SETTING PRINTING-TECHNOLOGY AND OTHER JOB-DEPENDENT PARAMETERS OF A PRINTING MACHINE

(75) Inventor: Eckart Frankenberger, Darmstadt (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/056,769

(22) Filed: Jan. 24, 2002

(65) Prior Publication Data

US 2002/0096077 A1 Jul. 25, 2002

(30) Foreign Application Priority Data

Jan. 24, 2001 (DE) ..... 101 03 039

(51) Int. Cl.[7] ..... B41L 39/00
(52) U.S. Cl. ..... 101/484; 400/76
(58) Field of Search ..... 101/484; 400/61, 400/70, 76

(56) References Cited

U.S. PATENT DOCUMENTS

| | | | |
|---|---|---|---|
| 5,625,758 | A | 4/1997 | Schneider et al. |
| 6,230,622 | B1 | 5/2001 | Dilling |

FOREIGN PATENT DOCUMENTS

| | | | |
|---|---|---|---|
| DE | 43 28 026 | A1 | 3/1995 |
| DE | 43 29 886 | A1 | 3/1995 |
| DE | 43 42 052 | A1 | 6/1995 |
| DE | 44 39 986 | A1 | 6/1995 |
| DE | 44 39 961 | A1 | 7/1995 |
| DE | 296 12 159 | U1 | 10/1996 |
| DE | 198 22 662 | A1 | 11/1999 |
| EP | 0 922 581 | A2 | 6/1999 |
| GB | 2 283 940 | A | 4/1995 |
| GB | 2 283 834 | A | 5/1995 |
| GB | 2 284 691 | A | 6/1995 |

OTHER PUBLICATIONS

Microsoft Press Computer Dictionary, Second Edition, pp. 269–270, 1994.*
Moritz Schwarz: "Vernetzt" [networked], dw, No. 8, Nov. 1999, pp. 40–41.
Dieter Kleeberg: "Die vernetzte Druckerei" [the networked printshop], *Supplement to KBA Report*, No. 14, drupa 2000.

* cited by examiner

*Primary Examiner*—Charles H. Nolan, Jr.
(74) *Attorney, Agent, or Firm*—Laurence A. Greenberg; Werner H. Stemer; Ralph E. Locher

(57) ABSTRACT

A method for setting machine settings for a printing machine at a time selected from before and during printing of a printed product on a printing machine, includes providing for one of an operator of the printing press and a pressman to evaluate a printed result of a printed product produced in one of a production printing and a proof printing, and resetting the machine settings, if necessary; in dependence upon an enabling signal, storing prescribed input variables and machine settings, which define a print job, in a control system belonging to the printing machine; and applying the stored values for influencing future settings of the printing machine, even for other print jobs; a printing machine for performing the method; and a material for printing with the printing machine.

17 Claims, 1 Drawing Sheet

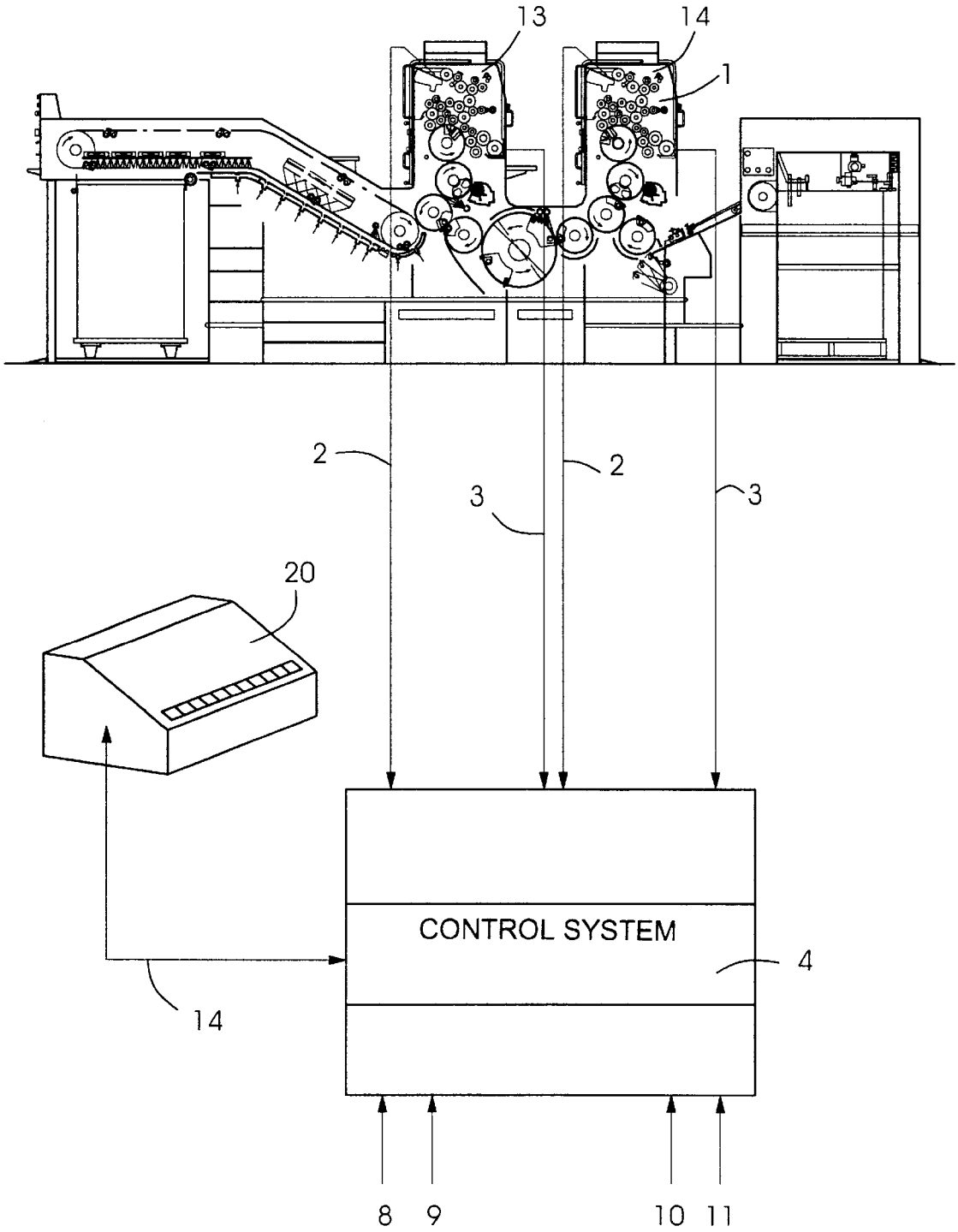
13
14
1
2
2
3
3
20
CONTROL SYSTEM
4
14
8
9
10
11

METHOD AND DEVICE FOR SETTING PRINTING-TECHNOLOGY AND OTHER JOB-DEPENDENT PARAMETERS OF A PRINTING MACHINE

BACKGROUND OF THE INVENTION

FIELD OF THE INVENTION

The invention relates to a method and device for setting printing-technology and other job-dependent parameters of a printing machine. The visual impression of a printed image, which can also contain text, is influenced by many factors. These include the state and type of paper used, the types of inks and dampening solution used and the admixtures thereof, the ink density required by the subject, the ink distribution, the sequence of inks printed over one another and the ambient conditions, such as atmospheric humidity and atmospheric temperature. In the case of planographic printing, particularly rotary offset printing, the ink supply and the water supply additionally play a part, having a great mutual influence on one another. The aforementioned influencing variables will be referred to hereinbelow as input values.

Some of the values listed (input variables) are associated with the material used or can be read via labeling and taken into account in the settings of a printing machine. These include, for example, the ink or paper that is used. Other predefined input variables are, for example, the ink distribution based upon the predefined subject, the sequence of inks printed above one another or the preselected printing speed. Input variables of this type are taken into account at the start of proof printing or production printing in the machine settings of the printing machine (such as ink zone openings, dampening solution setting, sheet-guiding blown air, dryer output).

Result parameters, such as the printed shade and the ink density achieved, can certainly be measured with some effort and can be reset on the printing machine. Here, however, the subjective impression of the operator on the printing machine is often more important than the measured result. One reason for this resides in the fact that all of the aforementioned parameters are subject to specific tolerances, so that the trained eye of the operator is more important for producing an optimum printed result than the results of predefined machine settings.

Settings on the printing machine do not have to be made just once but many times. A setting is necessary, for example, in order to produce a proof on a printing machine, which is most often specifically used for this purpose, the proof then being presented to the customer for assessment and to define the desired printed result. The measured values resulting from measurements on the proof (original) approved by the customer are then used as the basis for the setting up for continuous printing or production printing. Although, when setting up a printing machine in this way, a number of measured input variables are made available, the setting-up of a printing machine for continuous printing is still very complicated. Firstly, the tolerances of the measured input variables can add up in the direction of an unfavorable printed result, so that the operator (pressman) has to intervene simply for this reason. Furthermore, it may occur that the pressman would like to print at a speed which differs from the graduated characteristic values provided. Here, too, the set machine settings have to be modified appropriately in order to achieve an optimum printed result.

In planographic printing and, in particular, in rotary offset printing, finally, it is additionally necessary for the water feed and the ink distribution to be set until the printed result is satisfactory to the pressman. In order to achieve a good printed result, a stable equilibrium between ink and water must be reached (ink-water balance). While, as already outlined further hereinabove, the imprinting of the ink and the way it rests on the printed sheet can be measured by the pressman in the form of measuring the ink density, the optimum dampness cannot currently be measured directly with tolerable effort and adequate accuracy, but can only be assessed indirectly by the printed result. If too little water is transferred to the surface of the printing plate, the half-tone dots are then printed more fully (smearing), or the half-tone dots become filled in. The surface of the plate therefore picks up more ink than desired, because no adequate wetting has been carried out by the dampening unit. Conversely, in the event of excessive water feed, a pale printed result may occur, and therefore, from time to time, a high level of displacement of the printing ink results.

With regard to the ink distribution, care must be taken that the ink is distributed appropriately, depending upon the requirements of the subject, over the entire width of the printed product, i.e., transversely with respect to the direction of movement, in the case of rotary printing. For this purpose, the transfer of ink from the individual ink fountains or ducts to the ductor roller can be set in stripes, so that the ink is distributed on the ductor roller in accordance with the subject.

It therefore transpires that the procedure of setting up a machine is very time-consuming and, therefore, expensive. In order to shorten the set-up times, tables (or characteristic curves) are assigned to the individual printing machines, on the basis of which the ink distribution in a specific machine can be set as a function of the printing speed. Furthermore, in the case of some printing machines, paper data (format, thickness), the ink filling of the printing units and the ink distribution can be input or read in from the plate reader or the preprinting stage. For the purpose of controlling ink and dampening solution at different speeds, characteristic curves are used, although these have been determined for average values of ink zone openings.

The problem of the long times for setting up a printing machine is made even more critical by the fact that a setting, once selected, has to be adapted many times, for example, if the printing machine is stopped for a relatively long time, if the plates have to be changed or the rubber blanket has been washed. In order to provide a remedy here, the German Utility Model (DE-GM) 29612159 discloses the practice of recording individual set values in suitable memories, from which they can be output as required in order to set up the printing machine again. In this case, individual procedures, such as the washing of a rubber blanket or the printing of register marks, can have specific programs assigned thereto, which start up when the relevant program is to be performed. Appropriate programs can be provided to refresh the ink profile after a machine stoppage or after the setting of the dampening unit. The individual memories can be programmed freely and can, therefore, be adapted to the respective state or condition previously set.

Further times are needed in order to set the individual machine parameters if, during printing, in particular, production printing, there is a change in the required machine parameters to be set. This can occur, for example, as a result of the fact that the quantity of ink in the ink fountains decreases, and therefore the quantity of ink discharged at the set ink zone opening changes, or that the ambient temperature in the surroundings of the printing machine changes or other set values of the printing machine change, so that resetting is necessary. Because some of the described printed result parameters can be measured automatically with appropriate measuring instruments, in the interim, a series of printing machines have been equipped with control installations which, on a control strip on the printed sheet, compare measured actual values with prescribed desired or nominal values, and readjust the printing machine accordingly. Because control procedures of this type run relatively slower, compared with the machine speeds which can be reached presently, attempts have been made to shorten the control procedure. For example, the European Published Non-prosecuted Patent Application (EP-B) 922 581 describes control methods wherein, based upon prescribed starting conditions, a new condition in the printing machine is set in the manner of a step change. In this case, so-called fuzzy logic is used, wherein the functional units are approximated to the symbolism of non-quantitative human thought and, as a result, can be set up in a more fault-tolerant manner but also faster and more simply than in the case of conventional control. In the case of conventional control algorithms, even a small fault can lead to complete failure of the control system. In contrast therewith, in the case of fuzzy logic, a small fault will also manifest itself only slightly. The control procedures described in the aforementioned reference apply exclusively to the ink supply during the printing.

The conventional open-loop control devices represent some sort of aid during the automatic setting of printing machines before printing or during printing. The values determined from the machine via a large number of characteristic maps are able to represent only approximate guide values for the pressman, however, and have to be modified manually by him or her, as the case may be, in the direction of an optimum printed result. This applies both to setting up the printing machine before the start of production printing, and to setting up the machine during the printing procedure. In practice, the pressman is, therefore, often confronted by settings in the ink distribution or by faults which make it necessary to set the printing machine in a manner which differs greatly from the prescribed characteristic curves, so that, to some extent, readjustment of ink or dampening solution is required, which is complicated and results in considerable rejects. To some extent, this leads to the situation wherein the times for setting up and fine setting can become a major proportion of the machine time. Although a certain amount of help can be achieved by a specifically dense network of ink presetting characteristic curves, a great deal of effort is required to determine the characteristic curves. Furthermore, virtually every case is a special case which deviates from the characteristic curves and has to be readjusted manually.

SUMMARY OF THE INVENTION

The input values described at the introduction hereto may be divided into the prescribed values of the input variables and specific settings of the machine values by the pressman, which the pressman has to set based upon his subjective experience in order to improve the printed result of the printed product. The input variables are measured objectively or made known to the pressman by an appropriate description of the materials used for printing (paper, ink), the pressman then setting the machine appropriately. In this regard, by input variables there is meant variables which can be measured and defined objectively by material (for example, paper, ink), surroundings (temperatures, atmospheric humidity) and original (for example ink, distribution), and which influence the setting up of the printing machine. By machine settings, there are meant the settings on the printing machine which are performed by the pressman and made by the latter in order to achieve an optimum result, in particular including the specific settings which the pressman makes autonomously, as described further hereinabove.

The stored values defined as successful based upon the enable signal form a data set which describes a successful setting of the printing machine with regard to the fundamental input variables. The invention consists in principle of providing the control system with the input variables and the machine settings which are successful for this purpose in the opinion of the pressman, in such a way that these stored data sets can be used during subsequent print jobs to derive suitable machine settings.

The specific settings of the machine values by the pressman are made autonomously by him or her, as the case may be, because those values either cannot be measured at all or can be measured only with difficulty, or because the pressman wishes to deviate or must deviate from the machine settings proposed or preset from the characteristic curves in order to improve the printed result.

The input variables are prescribed by the parameters of the printing material, the parameters of the subject, the parameters of the surroundings, and specific machine parameters. With regard to the parameters for the printing material, for example, the paper format, the grammage, the paper thickness or the absorbency of the paper may be mentioned. With regard to the parameters of the subject, the ink distribution, the ink filling or the contrasts and halftones, respectively, may be mentioned. An input variable for a parameter of the printing machine is, for example, the anticipated printing speed. With regard to the input variables for the parameters of the surroundings, there are, for example, the temperature and the atmospheric humidity. The input variables are communicated to the pressman by descriptions of the materials used for the printing and are then input into the machine by the pressman or read in automatically by the machine.

The specific settings of the machine values by the pressman (machine settings) generally relate to the moisture (dampening solution supply) and the ink distribution (ink supply) and also the air setting for the paper transport. (The specific settings can, however, also relate to predefined input variables which the pressman modifies on his own account in order to improve the printed result of a printed product in the form of a machine setting, if this is at all possible.)

Further hereinabove, a description has already been given of the heretofore known attempts to accelerate the settings on printing machines or to improve them, by calling up the machine settings which have been kept ready in memories or by accelerating by fuzzy logic the control procedures for readjusting the ink supply.

It is an object of the invention of the instant application likewise to provide a method and device for setting printing-technology and other job-dependent parameters of a printing machine wherein the durations of the setting procedures are shortened, and the quality of the printed product is made more independent of the experience and qualification of the machine operator. The invention is based upon the fundamental concept that specific settings can be made very quickly (if necessary, automatically), because they are necessitated unambiguously by input variables. On the other hand, the specific settings of the machine values (machine settings) to be made by a pressman last for a comparatively long time and are often afflicted by a great deal of waste. These specific settings also require a great deal of specialist knowledge and a great deal of experience on the part of special staff, which are not always adequately available.

With the foregoing and other objects in view, there is provided, in accordance with one aspect of the invention, a method of setting machine settings for a printing machine at a time selected from before and during printing of a printed product on a printing machine, which comprises providing for one of an operator of the printing press and a pressman to evaluate a printed result of a printed product produced in one of a production printing and a proof printing, and resetting the machine settings, if necessary; in dependence upon an enabling signal, storing prescribed input variables and machine settings, which define a print job, in a control system belonging to the printing machine; and applying the stored values for influencing future settings of the printing machine, even for other print jobs.

In accordance with another mode, the method invention comprises providing the enabling signal which depends upon at least one of the number of printed products printed since a last change in the machine settings without renewed setting, and a manually input initiation signal.

In accordance with a further mode, the method invention includes providing prescribed input values selected from at least one member of at least one of the groups consisting of printing material parameters, subject parameters, ink parameters, dampening solution parameters and ambient parameters, the printing material parameters including paper format, grammage, paper thickness, stiffness and absorbency, the subject parameters including contrasts, ink distribution and ink filling, the ink parameters including tackiness and emulsifiability, and the ambient parameters including temperature and atmospheric humidity.

In accordance with an added mode, the method invention includes one of measuring the input variables of the printed result by automatically operating measuring instruments and, via a suitable coding of the printing materials, including paper, ink, dampening solution, taking over the input variables therefrom.

In accordance with an additional mode, the method invention includes providing the machine settings set by the pressman and stored in the control system from at least one of the setting of the ink distribution, the setting of the dampening solution and the setting of the air setting for the paper transport.

In accordance with yet another mode, the method invention includes, when setting up the printing machine for a new printed product, making available machine settings from the printing machine, which are influenced by appropriate values which have been stored in the control system during at least one of setting up and correcting preceding printed products.

In accordance with yet a further mode, the method invention includes making those machine settings available which depend upon the prescribed input variables of a new print job.

In accordance with another aspect of the invention, there is provided a printing machine for performing a method of setting printing-technology and job-dependent parameters of a printing machine, comprising a control system for the printing machine, the control system having a neural network which is capable of learning and in which input variables and machine settings are stored.

In accordance with a further feature of the invention, the machine settings are set in a specific combination of the input variables for influencing a weighting of processors operating in parallel in the neural network.

In accordance with an added feature of the invention, the weighting of the processors is additionally influenced by preceding machine settings including at least one of dampening solution, ink distribution and air setting for the paper transport.

In accordance with an additional feature of the invention, those machine settings which are unchanged by the neural network are made available as long as one of the input variables remains within a specific tolerance range.

In accordance with another aspect of the invention, there is provided a printing machine for performing a method for setting printing-technology and job-dependent parameters of a printing machine, comprising a barcode scanner for scanning characteristics of a material selected from the group consisting of paper and ink needed for a print job, the scanner being connected to a control receiving the scanned data from a barcode reader.

In accordance with a further feature of the invention, the control is a control system of the printing machine.

In accordance with an added feature of the invention, the barcode reader is a portable instrument.

In accordance with an additional feature of the invention, the barcode reader is disposed on one of a control system, an operating desk and a holder belonging to the printing machine and is intended for materials needed for printing.

In accordance with a concomitant aspect of the invention, there is provided a material for printing with a printing machine, the material being provided with a smart label.

Input variables are understood herein to mean variables which can be measured objectively and are defined by material (for example paper, ink), surroundings (for example temperatures, atmospheric humidity) and original (for example ink distribution), which influence the setting of the printing machine. Machine settings are understood to mean the settings on the printing machine which are made by the pressman and which the pressman makes in order to achieve an optimum result, in particular including the specific settings which the pressman makes autonomously, as described further hereinabove.

The values defined as successful on account of the enabling signal and stored form a data set which describes a successful setting of the printing machine with regard to the fundamental input variables. The invention consists in principle of providing the control system with the input variables and the machine settings which are successful in this respect in the opinion of the pressman, so that these stored values can be used during subsequent print jobs with corresponding input variables. This provides the precondition whereby the values or correction values created at considerable cost by the pressman in order to achieve a good printed result are also available for subsequent, comparable printing units.

In order to obtain an enabling signal in the simplest possible way, the pressman gives a signal by which he or she enables the specific machine values (machine settings) set autonomously by him or her to be handled further by the control system. Another possibility is that, by the control system, the specific machine values set independently by the pressman are declared to be mandatory, after the pressman has not input any new independent, specific machine values with regard to a sufficiently large number of printing procedures or printed sheets. In this case, too, the obviously successful machine settings are then made available to the control system for further application to subsequent new printed products. The parameters noted hereinbefore have proven to be input variables which can repeatedly be transferred smoothly. Typical machine settings noted hereinbefore, which have been set or modified autonomously by the pressman, are then made available to the control system on the basis of an enabling signal.

In an important refinement of the invention, when the printing machine is being set up for a new printed product, the control system alters the machine setting in a suitable way while taking into account the machine settings that have earlier proven to be successful, or makes at least corresponding proposals to the operator setting up the machine. In this way, a wealth of experience which has been obtained by the successful machine settings during comparable preceding printed products, at considerable cost, is also available for newer machine settings.

According to the refinement, the control system looks for an earlier combination of input variables which are as similar as possible to the current input variables of a new print job. On the basis of the earlier most similar combination of input variables found, conclusions are then drawn about successful current machine settings. Conclusions about current successful machine settings for new combinations of input variables are therefore drawn from the stored data sets (comprising input variables and successful machine settings).

The requirements imposed on the control system are therefore very varied when setting up the printing machine for a new printed product. It is necessary to check which earlier combination of input variables are sufficiently comparable with the input variables of the new print job to be set up. It is necessary to check what tolerances are permissible in the event of a deviation of the new combination from the earlier combination, and in the case of which input values only slight deviations can be tolerated. On the basis of the results found in this way, the new machine settings are then modified by the control system based upon the learned relationships in the stored data sets, or appropriate proposals are made to the operating personnel resetting the machine.

In a refinement of the invention, a printing machine having a control system particularly suitable for this purpose is proposed. Neural networks are extremely well suited to meet the present objective, because they are capable of learning. They therefore simulate the growing wealth of experience of a pressman.

It is preferable for the neural network of the printing machine to be configured in such a way that the processors or nodes operating in parallel recognize relationships between specific input variables with successful machine settings from the large number of data sets stored over the course of time. At the same time, the neural network learns, via a large number of data sets, which input variables in which combination were of particular importance for specific output variables (machine settings) . Furthermore, it is capable of weighting specific input variables in accordance with their importance. The increasing expression of central relationships between the input and output variables (=machine settings) constitutes, so to speak, the growing wealth of experience of the neural network, by which the experience of the pressman is simulated.

In accordance with a combination of features, the neural network outputs the machine settings which promised the greatest success, or makes appropriate proposals, as a function of the instantaneous combination of input variables as compared with similar preceding combinations of input variables. The values output are in this case not necessarily identical with machine settings set earlier, because it is entirely possible for a combination of input variables to be present which has never been present before. When building up the neural network, the input variables to be weighted are in particular the paper parameters (such as format, grammage, thickness, stiffness) and ink parameters (such as tack or tackiness and emulsifiability), the dampening solution characteristics, the ambient parameters (atmospheric humidity and atmospheric temperature) and also subject parameters (such as ink distribution and area coverage). The output variables to be selected are the machine settings, such as ink zone setting, dampening solution setting, blown air settings, and so forth.

In a development of the invention for the control of the printing machine, it is recommended that the control system be built up so as to be tolerant with respect to slight deviations of specific input variables. This means that the combination of the input variables can also lead to learned machine settings being output when the new combination of input variables is not identical with one of the preceding combinations but is comparable therewith only within specific tolerances.

One further possible way of simplifying the input of the input values, in particular of the input variables in the case of a printing machine, is described herein. The previously conventional method of inputting the input variables is for the pressman to read the appropriate characteristic values from the description of the materials supplied and to input these values into the control system via a comprehensive input menu. On account of this complicated input method, hitherto only comparatively few input variables have been input into the control system by the pressman, so that the setting of the machine settings made autonomously becomes particularly important. In order further to achieve the set object, therefore, a combination of the features is proposed for a printing machine. This advancement is based in principle upon using a barcode reader to read the code located on the label of the relevant material and describing the characteristic of the material, and of supplying the values read directly to the control system of the printing machine as input values. The control system then sets the relevant devices in the printing machine appropriately. However, this method assumes that the material is provided with a suitable barcode. In this case, the material can not only relate to the ink or the paper, but it is also possible for the type of dampening solution used, rubber blanket or cleaning agent for the machine to be described by an appropriate code. The connection of the scanner to the control system can be made via an electric line or else via a suitable information channel, such as an infrared beam, a radio channel or another transmission path.

In accordance with combinations of features, the code reader is transportable or permanently incorporated in the control system or devices belonging to the printing machine. If there is a transportable code reader, the pressman has the possibility of going to the material and performing the reading there, the data then being brought to the control system via a suitable transmission channel. If the code reader is permanently incorporated, the label with the barcode can be brought to the code reader and read there. One other possibility advantageously consists in arranging the code reader associated with a specific material in such a way on a holder for the respective material on the printing machine so that when the material is fed in, for example to the device in the printing machine, the respective code reader can readily read the relevant label.

It is particularly advantageous if the material is provided with a so-called "smart label". A smart label has the advantage that changes in the material during the printing operation can also be taken into account. For example, the reduction in a paper sheet pile during a preceding printing operation can be written into the smart label by a suitable code reader and writer. The smart label therefore acts like a credit card, wherein the last state of the characteristic of the material is entered. In this way, even changes in the characteristic of a material can be detected easily by a printing machine during a change on the printing machine.

The invention thus relates to a method of setting machine settings of a printing machine, and to a suitable printing machine for implementing this method. In order to arrive at an optimum printed result, a large number of parameters have to be set on the printing machine. Here, the setting of input variables that can be read via codes and tables can generally be carried out quite speedily. Considerably more time-consuming and therefore more expensive is the setting of machine settings such as dampening solution or ink supply by the pressman, who has to make these settings autonomously in order to optimize the printed result.

It is an object of the invention to shorten the settings to be made repeatedly by the pressman, for example, when setting up the printing machine for new printed products. The invention solves this problem in that the machine settings set by the pressman, together with a combination of the input variables are stored in a control system as a function of an enabling signal, these set machine settings being available for a subsequent set-up of the printing machine in the event of the presence of a corresponding combination of input values. An important advantage of the development of the invention consists in providing the control system with a neural network which is capable of learning and by which the changed settings made by the pressman, running repeatedly in the same direction, can be weighted appropriately and therefore proposed as output values by the control system. In order to set up the printing machine more simply, the invention further proposes the widespread use of (specific) barcode readers and smart labels.

Other features which are considered as characteristic for the invention are set forth in the appended claims.

Although the invention is illustrated and described herein as embodied in a method and device for setting printing-technology and other job-dependent parameters of a printing machine it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying single figure of the drawing, wherein:

BRIEF DESCRIPTION OF THE DRAWING

The single FIGURE in the instant application is a schematic and diagrammatic side elevational view of a sheet-fed rotary printing press incorporating the setting device according to the invention.

DESCRIPTION OF THE PREFERRED EMBODIMENT

Referring now to the single FIGURE of the drawing, there is shown therein an exemplary embodiment of the invention, in a printing machine for printing with two colors in offset printing. The invention, however, is entirely suitable for all types of modern printing machines. The printing machine 1 itself is not described in great detail hereinbelow. Closer details relating to offset printing machines can be obtained, for example, from the book "Der Offset-Druck" (Offset Printing), DuMont Buchverlag Köln, 1991.

The printing machine 1 is provided with a series of connections 2, 3 to one central or a plurality of decentralized control systems 4. The lines 2, 3 are shown as representative of further connections. Information which relates to the inking of a printing unit 13 or 14, respectively, is detected via sensors and communicated to the control system 4 via the connection line 2. This information can, for example, describe the position of the individual ink zones or knives along a ductor roller, which are set in accordance with the ink distribution. The information travelling over the connection 2 can also relate to the height of the ink stock in an ink fountain or other data important for the inking. Via the connection 3, for example, information can travel into the control system 4 for describing the dampening solution which, in the case of offset printing, is supplied to the corresponding rollers. What is important is that, representative of all of the other data, data travel via the connections 2, 3 for describing the setting of individual values in the printing machine, these settings being, in particular, machine settings which have to be reset many times by the pressman or have to be changed from print job to print job, respectively. The data travelling over the connections 2, 3 therefore represent data which can be set and/or reset autonomously by the pressman.

Via the lines 8, 9, information which relates to the type and characteristics of the inks used in the inking units 13, 14 pass into the control system 4. In this case, the data may concern, for example, the viscosity, tackiness, emulsifiability or the temperature value of the respective ink which is used. These values can be read from the packaging of the respective ink, for example, with the aid of a code, and then input into the control system 4 either manually or automatically (for example, can be read in automatically via so-called smart labels). Via the lines 10 and 11, information which describes the type and the characteristics of the paper that is used passes into the control system 4. Here, this may be, for example, the format, the grammage, the stiffness and the absorbency of the paper. The data which arrive in the control system 4 via the lines 8 to 11 therefore relate to input variables which objectively describe the print job and the conditions thereof (for example, atmospheric humidity in the print room or printing unit, atmospheric temperature in the printing unit, and so forth) and are representative of such values.

Finally, a control desk 20 is also shown in the drawing, via which the pressman can operate the printing machine 1 and via which he can read off the settings on the printing machine 1 or else set them by remote control. This information, such as the printing speed, ink zone settings or blower settings for the sheet guidance pass from the control desk 20 into the control system 4 via a line 14.

For example, the pressman can read off the input variables via the control desk 20 and, via the control system 4, select the machine values according to these input variables (for example, from tables or by measuring the original). During proof printing, or production or continuous printing, the pressman takes proof sheets and assesses the printed result. He then makes settings of the machine values autonomously, for example, by resetting the ink zones or the dampening solution. These set machine values are stored in the control system 4, this storage being performed in conjunction with the combination of the input variables which are present. However, the stored values are able to exert an influence upon the layout of future machine setting values as a successful data set comprising input and output variables only if the pressman either gives an appropriate command (enabling signal) via the control desk 20 or if, since the last setting, a predefined number of sheets has been produced without any new change by the pressman.

In order to shorten the time needed, respectively, for setting the machine values by the pressman, the control system 4 is provided with an artificial "neural network", which is not specifically illustrated, wherein the input values and the output values identified as successful are stored and which is able to learn the significance of certain input values or the combination thereof for the output values to be set over a large number of data sets. Suitable neural networks are described, for example, in the following references: "An Introduction to Computing with Neural Nets", IEEE ASSP MAGAZINE; April 1987, pages 4 to 22 and further references given there on page 22. The important factor is that such neural networks are capable of detecting the significance of a combination of input values for correspondingly successful output values and, from this learned relationship, are able to make proposals or presets for suitable machine settings. If, for example, a slight change in an individual input value with otherwise constant input values always has a great significance for specific output values, this relationship is then learned as important, and the relevant input value is weighted appropriately. Conversely, a specific input variable, for example, in spite of large fluctuations over wide ranges, may require no changes in output variables (machine settings), but if a specific threshold value is exceeded, then even small changes in the input variable are important. In this way, within the neural network, so to speak, a wealth of experience is built up about successful machine settings for specific input variables, which leads to the possibility that either suitable proposals be made to the pressman by the neural network for a machine setting to be performed by him or her, as the case may be, or that ultimately the neural network to a certain extent replace the resettings made by the pressman. In this way, for example, specific peculiarities of a printing machine, which does not behave exactly in accordance with the predefined characteristics, can be compensated for.

Setting up the printing machine may be simplified greatly for the pressman by using one or more barcode readers (for example at the end of the lines 8 to 11). By using code readers, a comparatively large number of input variables can be read without difficulty directly into the control system 4 of the printing machine 1 from the material intended for the printing. For example, a code reader (lines 10, 11) can be fitted on the feeder for the paper sheet pile in such a way that when moving the pile in or when the pile has been moved in, the reader reads the suitable values from a label on the pile. In this way, for example, not only can the grammage and the format of the paper be input simply into the control system 4, but also further additional suitable input variables, such as the stiffness of the paper. Other variables can be read off from the label of the ink container by the pressman, for example, with a transportable code reader (lines 8, 9), it being possible for the read-off values to be transmitted to the control system 4 directly by a radio link or optical transmission link, without any mechanical connection between the code reader and the control system 4.

It is particularly advantageous, when the input variables are being read off, if a so-called smart label is used, which interacts with a suitable code reader (which can also write). A smart label of this type is capable of being rewritten, in a manner similar to that of a credit card, by an appropriate code reader, so that changes in the material (for example, relating to the quantity thereof) can also be recorded, and the recorded changes are then readily available when the material is used in a new print job.

I claim:

1. A method of setting machine settings for a printing machine, which comprises:

evaluating a printed product produced in one of a production printing and a proof printing, and resetting the machine settings, if necessary, for optimizing a given print job;

storing prescribed input variables and machine settings characterizing the given print job in a control system belonging to the printing machine in dependence on an enabling signal;

comparing the stored input variables and machine settings representing prior print jobs with current input variables and machine settings of a new print job; and influencing the current input variables and machine settings by the stored input variables and machine settings coming closet to the current input variables and machine settings.

2. The method according to claim 1, which further comprises providing the enabling signal for resetting the machine setting which depends upon at least one of the number of printed products printed since a last change in the machine settings without renewed setting, and a manually input initiation signal.

3. The method according to claim 1, which further comprises providing prescribed input values selected from at least one member of at least one of the groups consisting of printing material parameters, subject parameters, ink parameters, dampening solution parameters and ambient parameters, the printing material parameters including paper format, grammage, paper thickness, stiffness and absorbency, the subject parameters including contrasts, ink distribution and ink filling, the ink parameters including tackiness and emulsifiability, and the ambient parameters including temperature and atmospheric humidity.

4. The method according to claim 1, which includes one step selected from those of measuring the input variables of the printed result by automatically operating measuring instruments and, via a suitable coding of the printing materials, including paper, ink, dampening solution, taking over the input variables therefrom.

5. The method according to claim 1, which includes providing the machine settings set by a pressman and stored in the control system from at least one of the steps of setting the ink distribution, setting the dampening solution and setting the air setting for the paper transport.

6. The method according to claim 1, which includes, when setting up the printing machine for a new printed product, making available machine settings from the printing machine, which are influenced by appropriate values which have been stored in the control system during at least one step of setting up and correcting preceding printed products.

7. The method according to claim 6, which includes making those machine settings available which depend upon the prescribed input variables of the new print job.

8. A printing machine, comprising:

a control system controlling the printing machine, said control system having a memory for storing prescribed input variables and machine settings characterizing a given print job in dependence on an enabling signal;

a neural network capable of neural learning for shortening a time needed for setting machine values by a printer; and a control device enabling comparison of the stored input variables and machine settings representing prior print jobs with current input variables and machine settings of a new print job and influence of the current input variables and machine settings by the stored input variables and machine settings coming closet to the current input variables and machine settings.

9. The printing machine according to claim 8, wherein said machine settings are set in a specific combination of said input variables for influencing a weighting of processors operating in parallel in said neural network.

10. The printing machine according to claim 9, wherein said weighting of said processors is additionally influenced by preceding machine settings including at least one setting selected from the group of setting dampening solution, setting ink distribution and setting air setting for the paper transport.

11. The printing machine according to claim 8, wherein those machine settings which are unchanged by the neural network are made available as long as one of said input variables remains within a specific tolerance range.

12. The printing machine according to claim 8, further comprising a barcode scanner for scanning characteristics of a material selected from the group consisting of paper and ink needed for a print job, said scanner being connected to said control system receiving the scanned data from said barcode scanner.

13. The printing machine according to claim 12, wherein said barcode scanner is a portable instrument.

14. The printing machine according to claim 12, wherein said barcode scanner is disposed on one of a control system, an operating desk, and a holder belonging to the printing machine for holding materials needed for printing.

15. A material for printing with a printing machine according to claim 12, the material being provided with a smart label readable by said barcode scanner.

16. The method according to claim 1, which further comprises:

scanning characteristics of a material selected from the group consisting of paper and ink using a barcode scanner, the scanner being connected to the control system for transmitting the scanned data from the barcode reader to the control system.

17. The method according to claim 16, which further comprises placing the barcode scanner on one of a control system, an operating desk, and a holder belonging to the printing machine for holding materials needed for printing.

* * * * *